US006041486A

United States Patent [19]

Forbis

[11] Patent Number: 6,041,486

[45] Date of Patent: Mar. 28, 2000

[54] METHOD OF ASSEMBLING A FENCE

[75] Inventor: John T. Forbis, York, Nebr.

[73] Assignee: Kroy Building Products, Inc., York, Nebr.

[21] Appl. No.: 09/238,754

[22] Filed: Jan. 28, 1999

Related U.S. Application Data

[62] Division of application No. 08/808,981, Feb. 19, 1997, Pat. No. 5,988,599.

[51] Int. Cl.[7] ..... B23P 11/02

[52] U.S. Cl. ..... 29/453; 256/24

[58] Field of Search ..... 256/24, 56, 66, 256/65, 19, 13.1, 59, 73, 34; 403/329; 29/453, 468

[56] References Cited

U.S. PATENT DOCUMENTS

| | | | |
|---|---|---|---|
| 3,395,489 | 8/1968 | Banse . | |
| 3,522,933 | 8/1970 | Braun . | |
| 3,648,981 | 3/1972 | Allen . | |
| 3,712,590 | 1/1973 | Tochner et al. | 256/34 |
| 3,924,834 | 12/1975 | Young . | |
| 4,027,855 | 6/1977 | Lauzier | 256/65 X |
| 4,188,019 | 2/1980 | Meredith | 256/73 X |
| 4,202,532 | 5/1980 | Mills . | |
| 4,346,872 | 8/1982 | Toruya . | |
| 4,585,214 | 4/1986 | Cope . | |
| 4,809,955 | 3/1989 | Veilleux . | |
| 4,962,914 | 10/1990 | Taylor | 256/65 |
| 5,011,325 | 4/1991 | Antonioli | 256/13.1 |
| 5,192,056 | 3/1993 | Espinueva . | |
| 5,200,240 | 4/1993 | Baker | 256/73 X |
| 5,215,290 | 6/1993 | Khalessi . | |
| 5,702,090 | 12/1997 | Edgman . | |

*Primary Examiner*—David P. Bryant
*Attorney, Agent, or Firm*—Clayton Howarth & Cannon, P.C.

[57] ABSTRACT

A modular fence system. The system includes fence planks designed for insertion into open channels of upper and lower fence rails. The fence rails are supported in a horizontal orientation between intermittent fence posts, with the fence planks extending vertically between the rails. The planks include resilient protrusions at their upper ends. The protrusions of the planks are designed to fit into internal passages formed in the open channels of the upper fence rail, into engagement with ledges defining the passages, to inhibit inadvertent removal of the planks from the upper rail.

16 Claims, 3 Drawing Sheets

METHOD OF ASSEMBLING A FENCE

This is a divisional of application Ser. No. 08/808,981, filed Feb. 19, 1997, entitled "FENCE SYSTEM," now U.S. Pat. No. 5,988,599.

BACKGROUND OF THE INVENTION

1. The Field of the Invention

The present invention relates generally to modular fence systems. More particularly, it concerns a modular fence plank that is lockably insertable into an channel of a fence rail.

2. The Background Art

Modular fence systems are becoming increasingly popular with home owners and businesses alike. Vinyl polymeric fence components have been designed for use in assembling an attractive fence.

The prior art modular fence systems are characterized by a number of disadvantages. Some systems require the laborious and time consuming practice of fastening the fence components with nuts and bolts or other fastening devices. Some of the more decorative-oriented fence systems utilize a lower fence rail to support substantially the entire weight of the planks of the fence, a design that requires a higher frequency of intermittent support posts to inhibit sagging in the lower fence rail.

OBJECTS AND SUMMARY OF THE INVENTION

It is therefore an object of the present invention to provide a fence system that is simple in design and easier to assemble.

It is another object of the invention to provide such a fence system that provides more support to fence planks of the system and thereby requires fewer intermittent support posts.

It is a further object of the invention to provide such a fence system having fence planks that are lockably insertable into supporting fence rails.

The above objects and others not specifically recited are realized in a specific illustrative embodiment of a modular fence system. The system includes fence planks designed for insertion into open channels of upper and lower fence rails. The fence rails are supported in a horizontal orientation between intermittent fence posts, with the fence planks extending vertically between the rails. The planks include resilient protrusions at their upper ends. The protrusions of the planks are designed to fit into internal passages formed in the open channels of the upper fence rail, into engagement with ledges defining the passages, to inhibit inadvertent removal of the planks from the upper rail.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
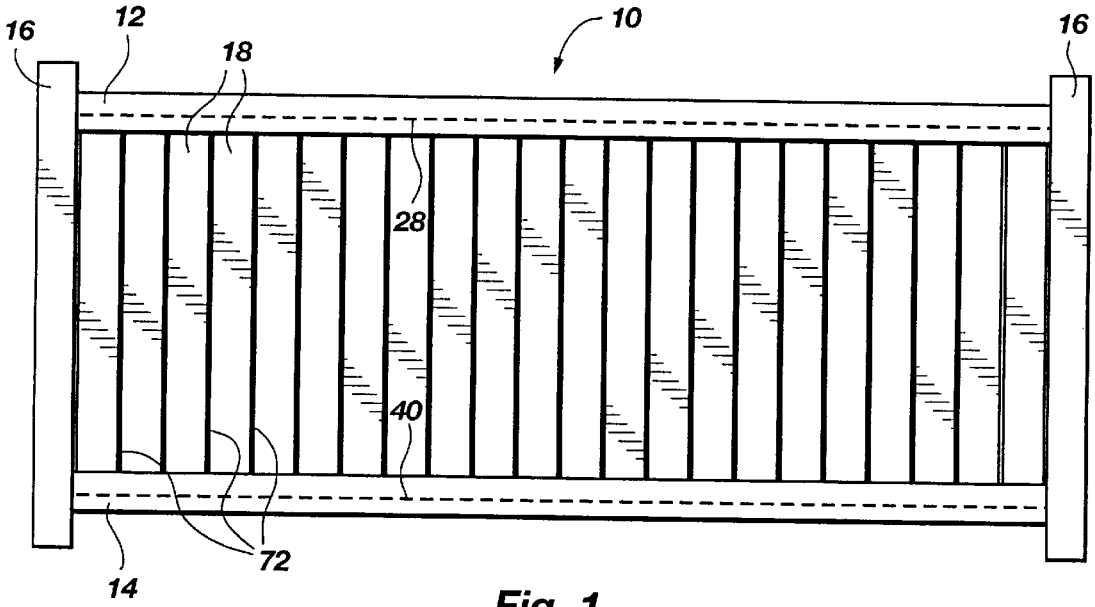
FIG. 1 is a frontal view of a fence system, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicant has discovered that a modular fence system can be designed that is easier to assemble, and requires a lower frequency of intermittent support posts. Applicant's inventive combinations as disclosed herein provide a fence system that requires less time to install, but is structurally sound and aesthetically pleasing.

Figure 2:
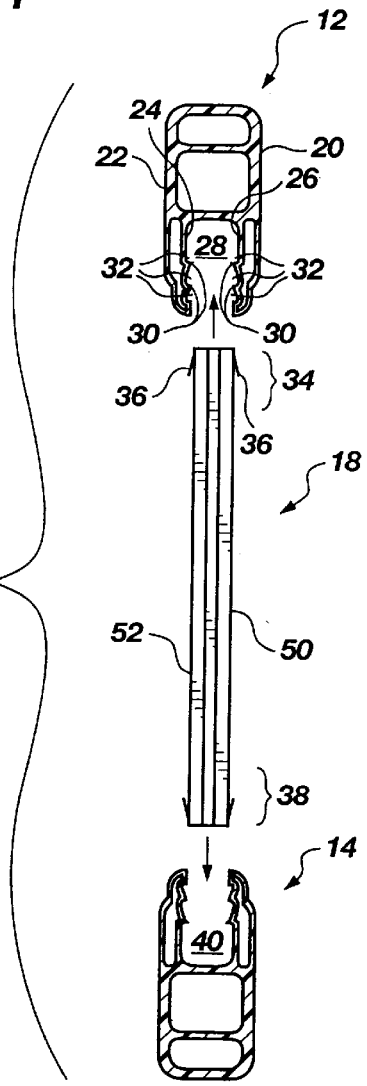
FIG. 2 is an exploded end view of a fence plank and upper and lower fence rails of the fence system of FIG. 1.
Figure 3:
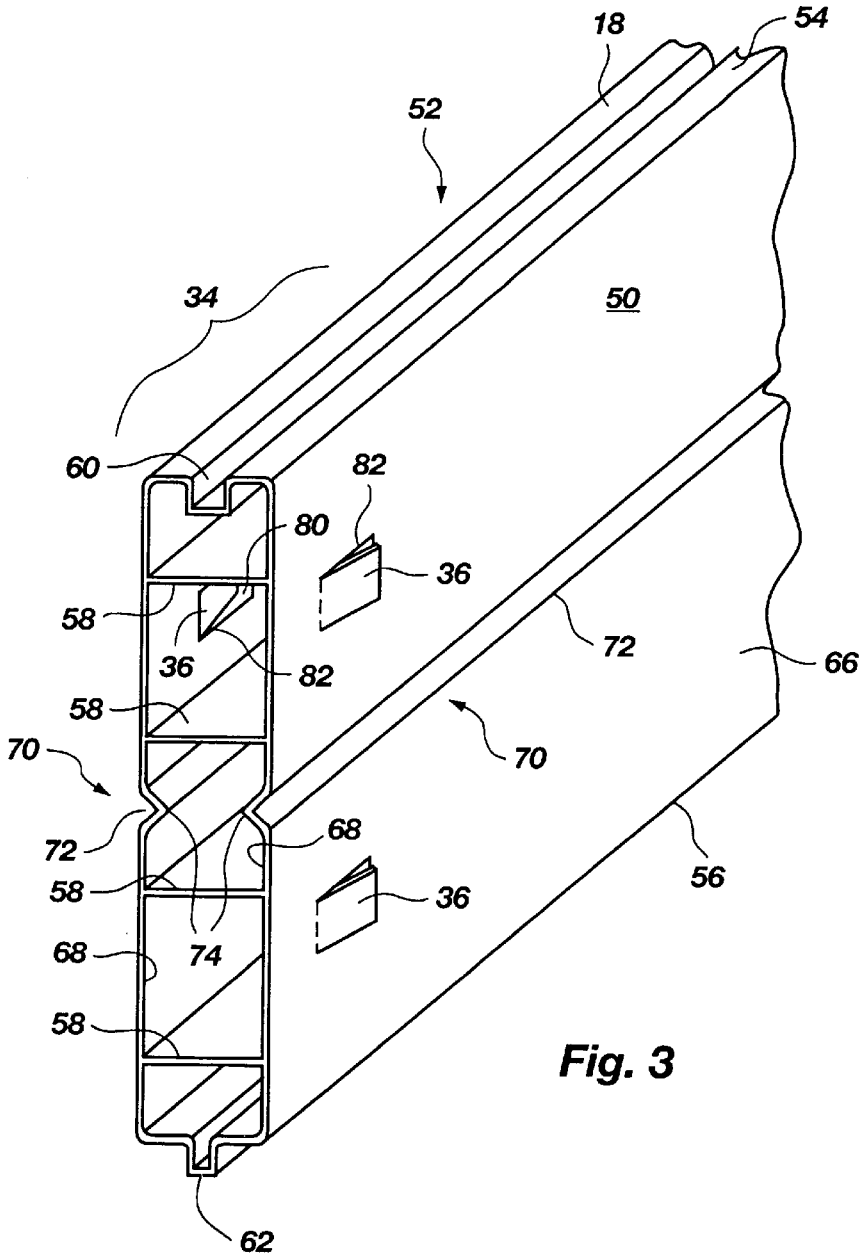
FIG. 3 is a perspective, break away view of the fence plank of FIG. 2.

Referring now to FIGS. 1–3, there is shown a fence system designated generally at 10 in FIG. 1. The fence system 10 includes upper and lower fence rails 12 and 14 coupled to intermittent fence posts 16. A plurality of fence planks 18 are supported between the upper and lower fence rails 12 and 14. The upper fence rail 12 is thus configured to be supported in a laterally extending, elevated orientation.

The upper fence rail 12 comprises a first side 20 and an opposing second side 22. A first interior side wall 24 and an opposing second interior sidewall 26 define an open channel 28 therebetween. The upper fence rail 12 includes ledges 30 protruding outwardly from the first and second interior sidewalls 24 and 26, respectively, for supporting the fence planks 18 thereon. Each ledge 30 defines a passage 32. The ledges 30 may also be referred to as channel-projections.

Each plank 18 preferably includes a first exterior end section 34 configured for inserting into the open channel 28 of the upper fence rail 12. Protrusions 36 are preferably formed in the planks 18 and extend outwardly from opposing sides of the first exterior end section 34 for protruding into the passages 32 defined by the ledges 30 on the first and second interior sidewalls 24 and 26, respectively. The protrusions 36 thereby engage against the protruding ledges 30 to inhibit inadvertent removal of the planks 18 from the upper fence rail 12. The protrusions 36 may also be referred to as plank-projections.

In this manner, the upper fence rail 12 provides structural support for the fence planks 18. The planks 18 are thus supported by both the upper and lower fence rails 12 and 14, as opposed to prior art fence systems wherein only the lower fence rail supports the planks. The fence posts 16 are spaced close enough together to inhibit substantially sagging of the lower fence rail 14. Since the fence system 10 distributes the weight of the planks 18 between both the upper rail 12 and the lower rail 14, the frequency of the fence posts 16 is less and thus fewer fence posts 16 are required, resulting in a saving of material cost and labor of installation.

Figure 4:
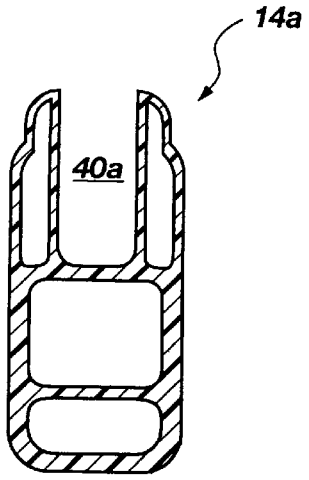
FIG. 4 is an end view of an alternative embodiment of the lower fence rail of FIG. 2.

Each fence plank 18 further includes a second end section 38 opposite the first end section 34. The lower fence rail 14 also has an open channel 40 formed therein for receiving the second end sections 38 of the planks 18 thereinto. The lower fence rail 14 is preferably identical to the upper fence rail 12 in design, and includes the ledges and passages, as shown in FIG. 2. Alternatively, the lower fence rail may comprise a rail 14*a* as in FIG. 4, defining a smooth open channel 40*a* and an absence of the internal ledges and passages.

The ledges 30 preferably comprise first and second arrays of elongate ledges extending lengthwise along the first and second interior sidewalls 24 and 26, respectively, to enable selective engagement of the protrusions 36 of the fence planks 18 against the ledges 32 of the first and second arrays, respectively. Preferably, each array of elongate ledges 30 comprises at least two ledges disposed in substantial parallel orientation as shown. The ledges 30 of the first and second arrays are equal in number to define pairs of ledges, each pair comprising a ledge from the first array and a ledge from the second array, such that the ledges in each pair are substantially parallel and reside common to a single plane extending substantially perpendicular to the sides 20 and 22 of the rail 12.

The upper fence rail 12 and the sidewalls 20, 22 and ledges 30 thereof preferably comprise a one-piece, unitary member made of a resilient material having elastic memory, such as vinyl. The protrusions 36 of the planks 18 also preferably comprise a resilient material having elastic memory. The feature of resilient material having elastic memory operates to permit a locking engagement of the protrusions 36 into the passages 32. The protrusions 36 can be "snapped" into place into the passages 32.

Referring more particularly to FIG. 3, the fence planks 18 are hollow, each plank having a front wall 50, an opposing rear wall 52, and a left sidewall 54 and a right sidewall 56 coupled between the front and rear walls 50 and 52 at opposing sides thereof, respectively. A plurality of internal bracing walls 58 are disposed between the rear wall 52 and the front wall 50. The left sidewalls 54 have an elongate channel 60 formed therein, and the right sidewalls 56 have an elongate projection 62 formed thereon configured and dimensioned to be inserted into the channel 60 of the left sidewalls 54 of adjacent planks 18 for additional support.

The front and rear walls 50 and 52 of each plank 18 include an exterior surface 66 and an interior surface 68, and preferably an elongate groove 70 is formed in each of said front and rear walls extending lengthwise along the plank 18. The elongate grooves 70 in the front and rear walls comprise a crease in said front and rear walls, defined by a furrow 72 formed in the exterior surface 66, and an opposing ridge 74 formed in the interior surface 68. The grooves 70 are optional, and the front and rear walls 50 and 52 may alternatively comprise substantially planer walls characterized by an absence of grooves or other nonplaner structure.

The grooves 70 define a kind of "V" shape as shown in FIG. 3. This structural variation provides increased strength to the front and rear walls 50 and 52, to inhibit buckling and bending. The "V" grooves 70 further provide an enhanced aesthetic appeal to the planks 18. The planks 18 preferably comprise a cross section of one inch by 8 inches, and the "V" grooves 70 produce the appearance four inch planks even though the planks are eight inches wide in reality.

Regarding the protrusions 36, the front and rear walls 66 and 68 of the planks 18 each include an opening 80 formed in the first end section 34 of the plank 18, such that a circumferential edge 82 defines said opening 80. The protrusions 36 extend outwardly from a portion of said circumferential edges 82. Most preferably, the protrusions 36 each comprise a severed portion of the walls 50 and 52 of the planks 18, whereby the protrusions 36 are simply cut apart from the front and rear walls 50 and 52 to form the openings 80, and the protrusions 36 are crimped into an outwardly extending orientation.

It is to be understood that one aspect of the present invention contemplates the plank 18 as in FIG. 3 without the protrusions 36 formed thereon. The upper and lower fence rails could simply function as retaining channels, such that no part of the plank extends into the passages 32 in a locking relationship against the ledges 30.

Figure 5:
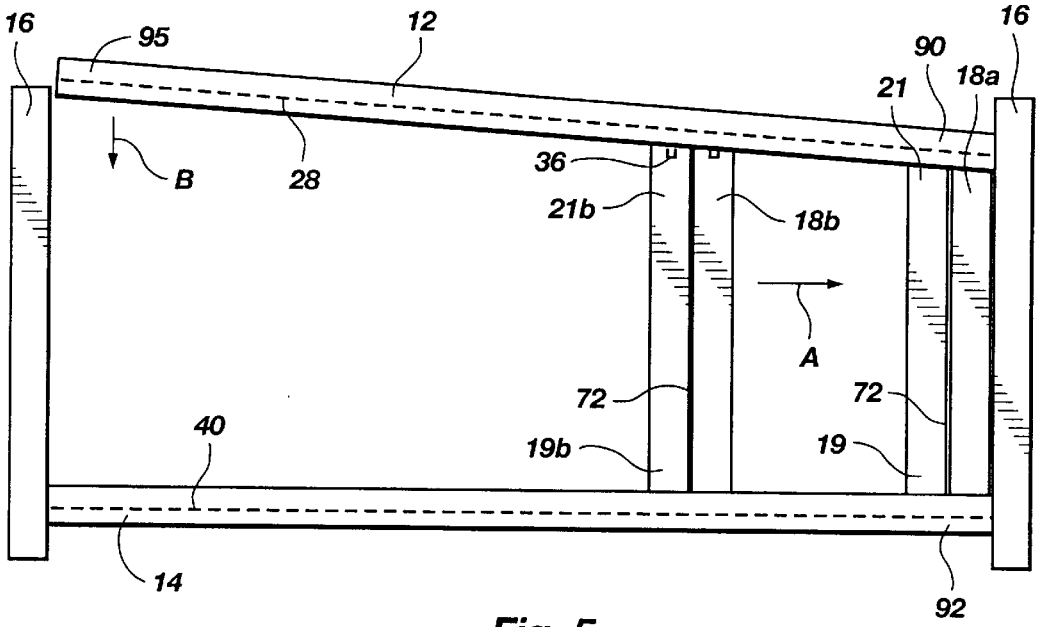
FIG. 5 is a frontal view of a partially assembled fence system being assembled in accordance with the principles of the present invention.

The fence system 10 can be assembled in any suitable manner. Referring now to FIG. 5, a preferred method of assembling a fence comprises the steps of:

(a) coupling a first end 90 of an upper fence rail 12 and a first end 92 of a lower fence rail 14 to a fence post 16, and maintaining an opposing second end 95 of the upper fence rail 12 in an elevated orientation with relative to the first end 90 of said upper fence rail 12;

(b) placing a lower end 19 of a first fence plank 18*a* into an open channel 40 of the lower fence rail 14, and an opposing upper end 21 of said first fence plank 18*a* into an open channel 28 of the upper fence rail 12;

(c) placing a lower end 19*b* of a following fence plank 18*b* into the open channel 40 of the lower fence rail 14 and sliding said following fence plank 18*b* toward the first fence plank 18*a* (as illustrated by arrow A);

(d) gradually lowering the second end 95 of the upper fence rail 12 (as illustrated by arrow B) such that an upper end 21*b* of the following fence plank 18*b* becomes received into the open channel 28 of the upper fence rail 12;

(e) repeating steps (c) and (d) as many times as desired to thereby situate an array of fence planks 18 into position between the upper and lower fence rails 12 and 14.

The method set forth immediately above may be further augmented, wherein step (b) further comprises placing a protrusion 36 of the first fence plank 18*a* into an internal passage 32 (see FIG. 2) 28 of the upper fence rail 12 and into engagement with a ledge 30 defining the passage, and wherein step (d) further comprises placing a protrusion 36 of the following fence plank 18*b* into an internal passage 32 of the upper fence rail 12 and into engagement with a ledge 30 defining said internal passage.

Figure 6:
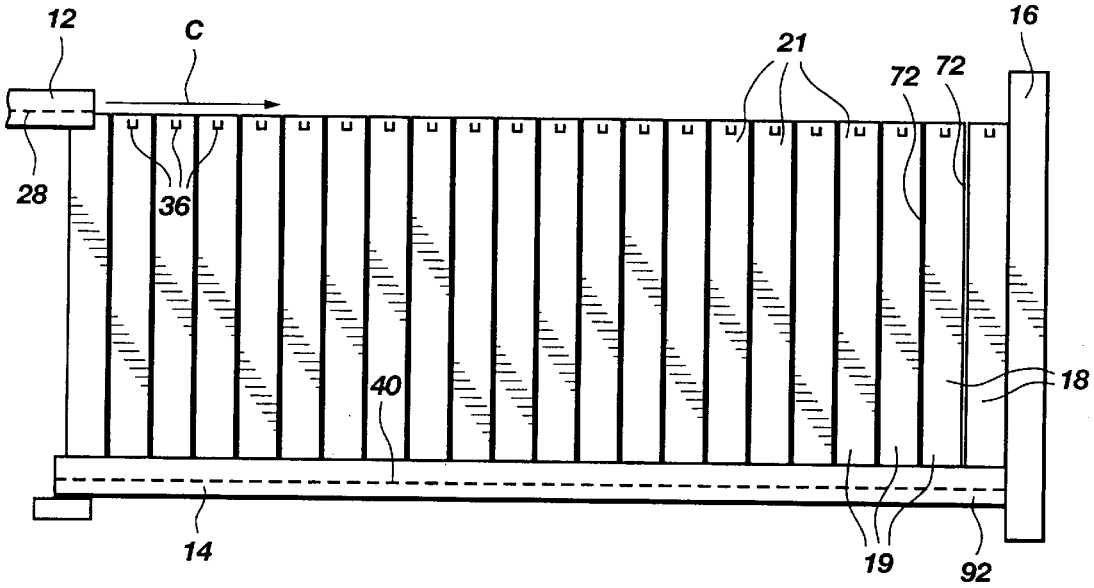
FIG. 6 is a frontal view of a partially assembled fence system being assembled in accordance with an alternative method of assembly.

Referring now to FIG. 6, a further method of assembling a fence comprises the steps of:

(a) coupling a first end 92 of a lower fence rail 14 to a support post 16;

(b) placing lower ends 19 of a plurality of fence planks 18 into an open channel 40 of the lower fence rail 14; and (c) sliding an upper fence rail 12 onto upper ends 21 of the plurality of fence planks 18 (illustrated by arrow C) such that said upper ends 21 of the planks 18 reside in an open channel 28 of the upper fence rail 12 with protrusions 36 on said upper ends 21 extending into an internal passage 32 (shown in FIG. 2) of the upper fence rail 12 and into engagement with a ledge 30 (shown in FIG. 2) defining said internal passage.

The method set forth immediately above may be further augmented, wherein step (c) further comprises sliding the upper fence rail 12 sequentially along the upper ends 21 of the plurality of fence planks 18.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A method of assembling a fence, said method comprising the steps of:

(a) coupling a first end of an upper fence rail and a first end of a lower fence rail to a fence post, and maintaining an opposing second end of the upper fence rail in an elevated orientation relative to the first end of said upper fence rail;

(b) placing a lower end of a first fence plank into an open channel of the lower fence rail, and an opposing upper end of said first fence plank into an open channel of the upper fence rail;

(c) placing a lower end of a following fence plank into the open channel of the lower fence rail and sliding said following fence plank toward the first fence plank;

(d) gradually lowering the second end of the upper fence rail such that an upper end of the following fence plank becomes received into the open channel of the upper fence rail;

(e) repeating steps (c) and (d) as many times as desired to thereby situate an array of fence planks into position between the upper and lower fence rails.

2. The method of claim 1, wherein step (b) further comprises placing a protrusion of the first fence plank into an internal passage of the upper fence rail and into engagement with a ledge defining the passage, and wherein step (d) further comprises placing a protrusion of the following fence plank into an internal passage of the upper fence rail and into engagement with a ledge defining said internal passage.

3. The method of claim 1, wherein the upper rail includes channel-sidewalls defining the open channel, at least one of said channel sidewalls having at least one channel-projection extending outwardly from a surface of said channel-sidewall;

wherein step (d) further comprises placing the at least one channel-projection into engagement with the upper ends of the fence planks when said fence planks are placed into the open channel, for increased support of the fence planks.

4. The method of claim 3, wherein the fence planks reside in a spaced apart, non-contacting orientation with respect to the surface of the channel-sidewall having the channel-projection.

5. The method of claim 1, wherein the upper rail includes channel-sidewalls defining the open channel and wherein the fence planks each include at least one plank-projection formed as part of said fence plank, said plank-projection extending outwardly from a surface of the fence plank;

wherein step (d) further comprises placing the at least one plank-projection into engagement with one of the channel-sidewalls when said fence planks are placed into the channel, for increased support of the fence planks.

6. The method of claim 1, wherein the upper rail includes channel-sidewalls defining the open channel and wherein at least one of said channel sidewalls includes at least one channel-projection extending outwardly from a surface of said channel-sidewall, and wherein the fence planks each include at least one plank-projection formed as part of said fence plank, said plank-projection extending outwardly from a surface of the fence plank;

wherein step (d) further comprises lowering the second end of the upper fence rail to thereby snap the at least one channel-projection past the at least one plank-projection such that said plank-projection resides in engagement with the at least one channel-projection when said fence planks are placed into the channel, for increased support of the fence planks.

7. A method of assembling a fence, said method comprising the steps of:

(a) coupling a first end of a lower fence rail to a support post;

(b) placing lower ends of a plurality of fence planks into an open channel of the lower fence rail; and (c) sliding an upper fence rail sequentially onto upper ends of the plurality of fence planks, one by one in a lateral direction, such that said upper ends of the planks reside in an open channel of the upper fence rail with protrusions of said upper ends extending into an internal passage of the upper fence rail and into engagement with a ledge defining said internal passage.

8. A method of assembling a fence, said method comprising the steps of:

(a) coupling a first end of an upper fence rail and a first end of a lower fence rail to a fence post, such that the first end of the upper fence rail is pivotally coupled to the fence post to thereby enable an opposing second end of the upper fence rail to be held in an elevated orientation relative to said first end and moved downwardly while said first end moves pivotally relative to the fence post;

(b) placing a lower end of a first fence plank into an open channel of the lower fence rail, and an opposing upper end of said first fence plank into an open channel of the upper fence rail;

(c) placing a lower end of a following fence plank into the open channel of the lower fence rail and sliding said following fence plank toward the first fence plank;

(d) gradually lowering the second end of the upper fence rail such that an upper end of the following fence plank becomes received into the open channel of the upper fence rail;

(e) repeating steps (c) and (d) as many times as desired to thereby situate an array of fence planks into position between the upper and lower fence rails.

9. The method of claim 8, wherein step (a) further comprises inserting the first end of the upper fence rail into an opening formed in the fence post, wherein the opening is sufficiently larger than a width of the first end of the upper fence rail to thereby permit pivotal movement of said upper fence rail about said opening, said opening thereby operating as a pivot point.

10. The method of claim 8, wherein the upper rail includes channel-sidewalls defining the open channel, at least one of said channel sidewalls having at least one channel-projection extending outwardly from a surface of said channel-sidewall;

wherein step (d) further comprises lowering the second end of the upper fence rail to thereby snap the at least one channel-projection past the at least one plank-projection such that said plank-projection resides in engagement with the at least one channel-projection when said fence planks are placed into the channel, for increased support of the fence planks.

11. The method of claim 8, wherein the upper rail includes channel-sidewalls defining the open channel and wherein the fence planks each include at least one plank-projection formed as part of said fence plank, said plank-protection extending outwardly from a surface of the fence plank;

wherein step (d) further comprises lowering the second end of the upper fence rail to thereby snap the at least one channel-projection past the at least one plank-projection such that said plank-projection resides in engagement with the at least one channel-projection when said fence planks are placed into the channel, for increased support of the fence planks.

12. The method of claim 8, wherein the upper rail includes channel-sidewalls defining the open channel and wherein at least one of said channel sidewalls includes at least one channel-projection extending outwardly from a surface of said channel-sidewall, and wherein the fence planks each include at least one plank-projection formed as part of said fence plank, said plank-projection extending outwardly from a surface of the fence plank;

wherein step (d) further comprises lowering the second end of the upper fence rail to thereby snap the at least one channel-projection past the at least one plank-projection such that said plank-projection resides in engagement with the at least one channel-projection when said fence planks are placed into the channel, for increased support of the fence planks.

13. A method of assembling a fence, said method comprising the steps of:

(a) coupling a first end of a lower fence rail to a fence post;

(b) placing a lower end of a first fence plank into an open channel of the lower fence rail;

(c) placing a lower end of a plurality of following fence planks into the open channel of the lower fence rail and sliding said following fence planks toward the first fence plank into a desired position such that the first plank and the following fence planks comprise pre-placed fence planks:

(d) coupling a first end of an upper fence rail to the fence post above the planks residing in the open channel of the lower fence rail and maintaining an opposing second end of the upper fence rail in an elevated orientation relative to the first end of the upper fence rail; and (e) gradually lowering the second end of the upper fence rail toward the pre-placed fence planks to thereby cause upper ends of the fence planks to become inserted into an open channel of the upper fence rail in a sequential, one-by-one manner to thereby situate an array of fence planks into position between the upper and lower fence rails.

14. The method of claim 13, wherein the upper rail includes channel-sidewalls defining the open channel, at least one of said channel sidewalls having at least one channel-projection extending outwardly from a surface of said channel-sidewall;

wherein step (d) further comprises lowering the second end of the upper fence rail to thereby snap the at least one channel-projection past the at least one plank-projection such that said plank-projection resides in engagement with the at least one channel-projection when said fence planks are placed into the channel, for increased support of the fence planks.

15. The method of claim 13, wherein the upper rail includes channel-sidewalls defining the open channel and wherein the fence planks each include at least one plank-projection formed as part of said fence plank, said plank-projection extending outwardly from a surface of the fence plank;

wherein step (d) further comprises lowering the second end of the upper fence rail to thereby snap the at least one channel-projection past the at least one plank-projection such that said plank-projection resides in engagement with the at least one channel-projection when said fence planks are placed into the channel, for increased support of the fence planks.

16. The method of claim 13, wherein the upper rail includes channel-sidewalls defining the open channel and wherein at least one of said channel sidewalls includes at least one channel-projection extending outwardly from a surface of said channel-sidewall, and wherein the fence planks each include at least one plank-projection formed as part of said fence plank, said plank-projection extending outwardly from a surface of the fence plank;

wherein step (d) further comprises placing the at least one plank-projection into engagement with the at least one channel-projection when said fence planks are placed into the channel, for increased support of the fence planks.

* * * * *